United States Patent [19]

Breitscheidel et al.

[11] Patent Number: 4,542,057

[45] Date of Patent: Sep. 17, 1985

[54] HAMMOCK

[75] Inventors: Hans-Ulrich Breitscheidel, Siegburg; Walter H. Anshen, Cologne; Rudolf Kautz, Hennef, all of Fed. Rep. of Germany

[73] Assignee: Dynamit Nobel Aktiengesellschaft, Troisdorf, Fed. Rep. of Germany

[21] Appl. No.: 678,045

[22] Filed: Dec. 4, 1984

[30] Foreign Application Priority Data

Dec. 17, 1983 [DE] Fed. Rep. of Germany ... 8336302[U]

[51] Int. Cl.[4] ..... B32B 3/04

[52] U.S. Cl. ..... 428/126; 5/120; 428/124; 428/292; 428/294; 428/246; 428/252; 428/253; 428/284; 428/304.4

[58] Field of Search ..... 5/120; 428/292, 294, 428/247, 252, 253, 304.4, 124, 126, 246, 284

[56] References Cited

U.S. PATENT DOCUMENTS

| | | | |
|---|---|---|---|
| 3,328,225 | 6/1967 | Urbanic et al. | 428/252 |
| 3,336,180 | 8/1967 | Werner | 428/252 |
| 3,855,048 | 12/1974 | Bagnall | 428/246 |
| 4,199,639 | 4/1980 | Ronc | 428/300 |
| 4,474,840 | 10/1984 | Adams | 428/304.4 |

*Primary Examiner*—James J. Bell

*Attorney, Agent, or Firm*—Antonelli, Terry & Wands

[57] ABSTRACT

A hammock having a mat portion and loop-shaped arrangement at the head and foot ends of the mat portion to accommodate mounting dowels, said mat portion comprising an elastic crosslinked synthetic resin foam sheet, reinforced with a flat textile layer or organic and/or inorganic fibers, threads, strips, or the like, said sheet having a tensile strength of at least 0.20 $N/mm^2$, a tear propagation resistance of at least 1.0 N/mm, and an ultimate elongation of at least 80%, with a gross density of about 30–130, preferably 30–80 $kg/m^3$.

10 Claims, 3 Drawing Figures

HAMMOCK

This invention relates to a hammock with a mat and a loop-shaped arrangement at the head and foot to accommodate mounting dowels.

Hammocks made, for example, of knotted nets are conventional; besides having to satisfy the strength requirements to bear the weight of a person, they must also be weather-resistant since they are used predominantly in the open air.

The invention is based on the object of providing a novel hammock exhibiting a maximally great reclining comfort, a simple handling, and a low weight. In order to attain this object, a hammock is provided in accordance with the invention wherein a central portion in the form of a bed or mat is made up of an elastic crosslinked foam sheet reinforced with a flat textile web, layer or strip of organic and/or inorganic fibers, threads, strips, or the like, the sheet having a tensile strength of at least 0.20 N/mm$^2$, a tear propagation resistance of at least 1.0 N/mm, and an ultimate elongation of at least 80–120%, with a gross density of about 30–130, preferably 30–80 kg/m$^3$. Suitable elastic crosslinked foam materials are, for example, the closed-cell, chemically crosslinked or crosslinked by irradiation polyolefin foams; e.g., polyethylene foams, which are water-repellant and exhibit good light stability, and which simultaneously also show cushioning and insulating effects. The textile reinforcement can preferably be a coarse reinforcing woven, or nonwoven, fabric or knit which is either applied to one side or is laminated between two foam sheets as the intermediate layer. The preferred lamination process is the flame lamination, whereby preferably at least the surface of the foam sheet is melted and the reinforcement layer is bonded by pressing against the melted foam sheet surface. A nonbulky flat textile material that can be utilized advantageously consists of a fabric, especially one woven from small ribbons, based on synthetic resins such as polyolefins, such as, for example, polyethylene strips. In order to be able to hang up the hammock, the head and foot ends of the foam sheet are preferably folded over to form loops, and the folded-over portion is connected to the bed or mat, especially by welding, gluing, or sewing. A mounting dowel of wood, metal or like material, can then be inserted in the thus-formed loop, the ropes for suspending the hammock then being attached to this dowel. However, it is also possible to sew, weld, or glue to the topside and/or underside of the bed at the head and foot thereof, in particular a woven or knit or nonwoven, flat textile material; e.g., a fabric of a synthetic resin, with formation of a loop. The loop can be arranged continuously over the entire width of the bed along the head and foot ends, but it is also possible to attach merely loop sections at various zones. The material for the loops, besides being a flat textile material, can also consist of a synthetic resin sheet; a selection of material making it possible to effect a homogeneous bond, for example by welding, with the material of the bed, is advantageous.

In order to improve the surface of the mat or bed and in some cases also the esthetic effect, the surface of the foam sheet forming the mat or bed can be laminated with a synthetic resin film, for example a polyolefin film, if the foam material consists of polyolefins. The lamination can be provided by flame lamination, whereby preferably the surface of the foam sheet is melted by the flame that the synthetic resin film can stick to it. Such a thin film of about 30–50$\mu$ thickness can also be dryed in a color, or imprinted; moreover, it is possible to emboss same in a simple way in order to improve the surface handle of the bed.

With the use of the foam sheets of selected gross densities provided according to this invention, which do not let the weight of the bed mat become too high and yet exhibit adequate strength properties, it is possible to manufacture hammocks having a reclining surface of about 2 m in length up to 1 m in width, wherein the bed can have a thickness of about 5 and 20 mm. The bed can here consist of a foam sheet or of two laminated-together foam sheets. The preferred lamination process is the flame lamination. It is also possible to combine two foam sheets having differing gross densities with each other; in this case, the foam sheet having the lower gross density is made with a softer characteristic and constitutes the topside of the bed; whereas a foam sheet having a higher gross density and, thus, being more rigid forms the underside of the bed and, in a composite with the textile reinforcement, takes care of an adequate absorption of the load stresses.

A special advantage of the hammock of this invention is to be seen in that it is very durable and has a long service life on account of the fungi-inert materials utilized and, moreover, ensures high reclining comfort due to the inserted elastic foam sheets. If the hammock remains in the open air for a relatively long time period, it is likewise possible to perforate the hammock in the central zone to take care of simple drainage in this way. Furthermore, the bed can also be perforated at certain spacings for reasons of increasing air circulation.

The drawings illustrate the invention by means of examples. In the drawings.

Figure 1:
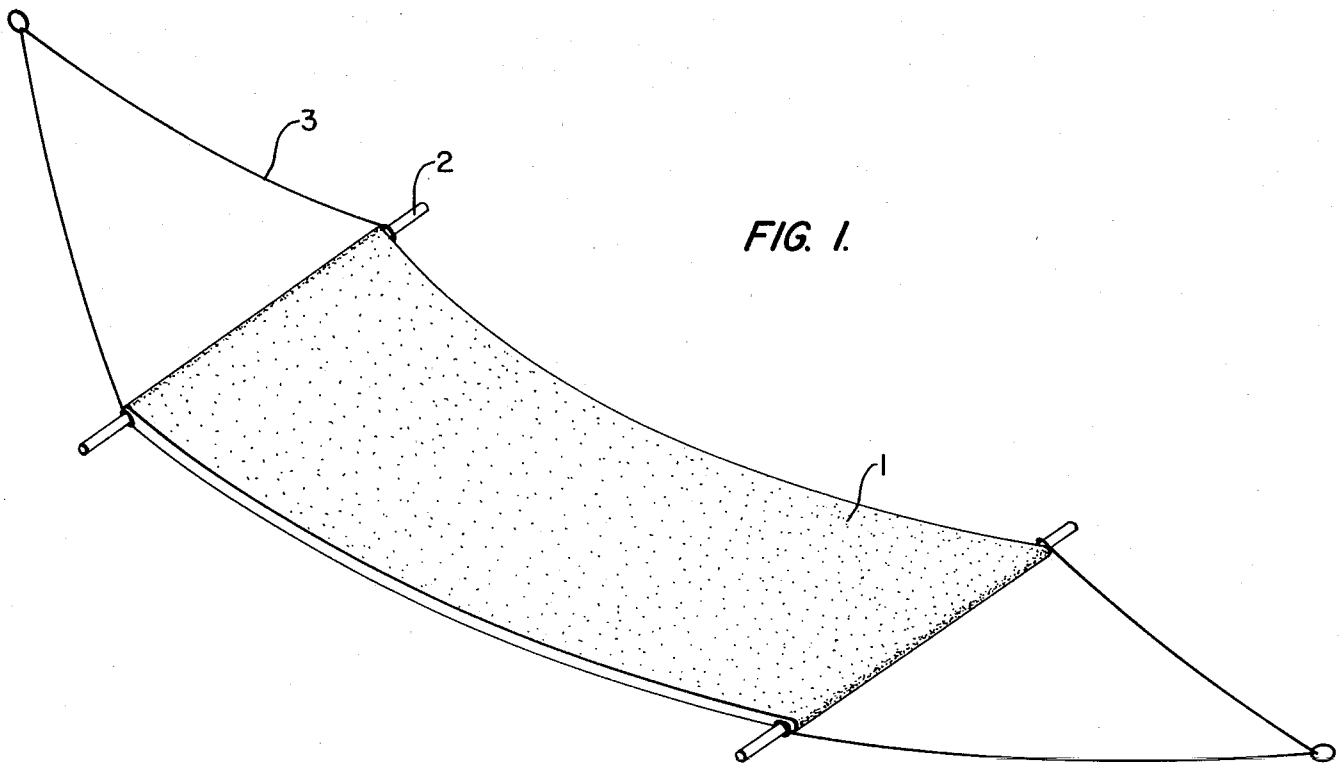
FIG. 1 is a schematic view of a hammock.

FIG. 1 illustrates the principle of a hammock consisting essentially of the bed or mat 1 serving for the accommodation of one person, the bed 1 being joined at its head and foot, respectively, to the dowel 2 engaged by the supporting ropes 3 for suspension of the hammock. The dowels 2 are preferably passed through a loop-shaped arrangement of the head and foot of the bed and held therein.

Figure 2:
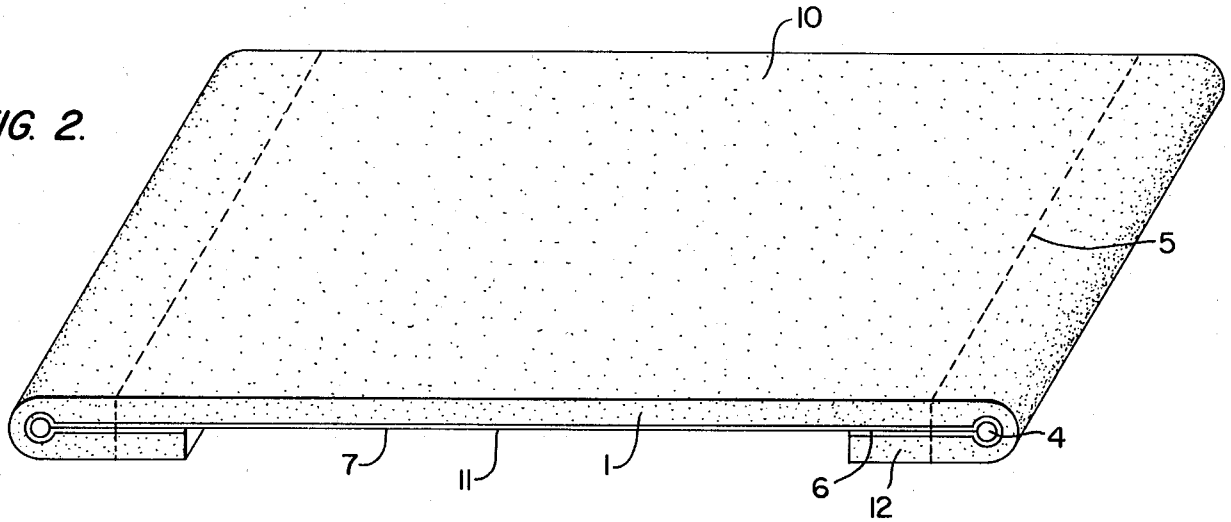
FIG. 2 is a schematic view of a bed or mat part of the hammock.

FIG. 2 shows schematically the construction of the bed or mat 1. In this arrangement, the bed 1 consists, for example, of a foam sheet made up of chemically crosslinked polyethylene foam having a closed-cell structure with a thickness of 10 mm and a length of the bed of 1.70–2.50 m, preferably about 2 m, and a width of about 0.6–1.0 m. The foam has, for example, a gross density of 50 kg/m$^3$, a tensile strength, measured according to DIN 53571, of 0.4 N/mm$^2$, an ultimate elongation, measured according to DIN 53571, of 90%, a tear propagation resistance, measured according to DIN 53577, of 1.9 N/mm, compressive stress at 25% deformation, measured according to DIN 53577, of 70 kN/m$^2$, an impact resilience, measured according to DIN 53512, of 45%, and a water absorption after 28 days, measured according to DIN 53428, of smaller than 3.0 vol-%, and a water vapor diffusion resistance factor $\mu$, measured according to DIN 53429, of 3000. The topside 10 of the foam sheet forming the bed 1, which is the reclining side, can be embossed, for example, or optionally laminated with a synthetic resin film, for example a polyethylene film having a thickness of 30–50μ, and embossed. The underside 11 of the foam sheet forming the bed is reinforced by a fabric 7, not shown in detail, which is incorporated by laminating, for example of polyester threads or polyamide threads or polypropylene threads or a fabric or woven polyethylene strips. The foam sheet for the bed 1 is folded over along the short ends; i.e., at the ends forming the head and foot, and the folded-over edge 12 is connected, in the zone 6 of the bed, for example by gluing or welding and/or sewing along one or several seams 4. The dowels for suspending the hammock can then be passed through the loop 4 formed in this way. The hammock of this invention is flexible and can be readily reduced in size by rolling up and thus transported. It is very easy to clean and conveys a pleasant reclining feeling on account of the cushioning action of the sheet of foam material employed.

Figure 3:
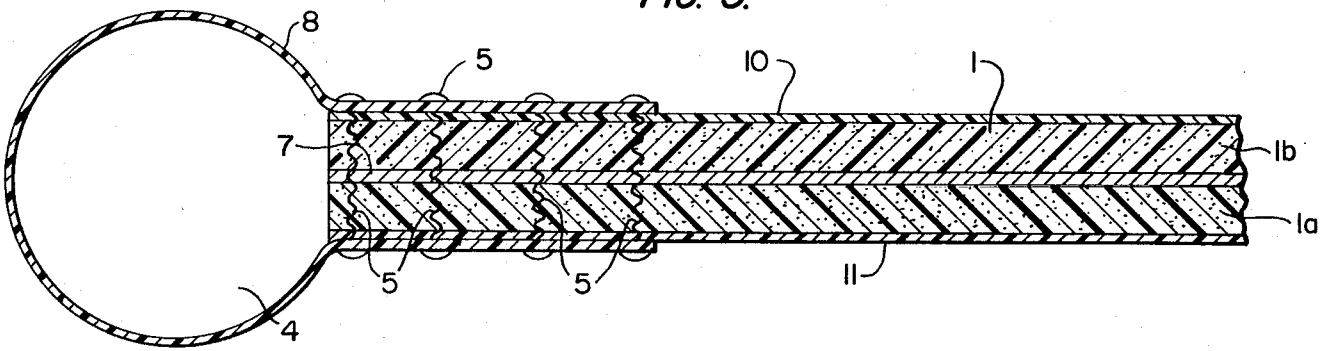
FIG. 3 is a fragmentary cross-sectional view of the bed or mat part.

FIG. 3 shows another possibility for constructing the hammock of this invention. In this arrangement, the mat 1 is formed by two foam sheets 1*a*, 1*b* between which the textile reinforcing layer 7 is laminated in place. However, it is also possible to directly laminate the two foam panels 1*a*, 1*b* together and to arrange the textile reinforcing layer 7 on the underside, as shown in FIG. 2. In the hammock according to FIG. 3, the two exteriorly located sides of the foam panels 1*a*, 1*b*; namely, the topside 10 and the underside 11, are either embossed or laminated to cover layer, for example, a synthetic resin film which can optionally be embossed, or they are also provided with a fabric-like casing, for example, on the basis of synthetic-resin and/or natural fibers. For accommodating the mounting dowels, loops 4 are provided, for example, at the end faces of the bed mat, by welding or gluing or sewing, optionally in addition to an adhesive bond, of strips 8 which can consist, for example, or synthetic-resin fibers, such as, e.g., a woven product of polyethylene ribbons. Also riveting of the loop-forming strips 8 to the mat 1 is possible.

Polyester fabrics or polyamide fabrics, for example can also be utilized as the reinforcing flat textile article, or fabrics additionally coated with PVC or polyethylene. It is, moreover, possible to dye the topside and underside of the bed with different colors; in this case, a hammock fastened according to FIG. 3 can be used as the reclining surface with both of its sides.

What is claimed is:

1. A hammock having a mat portion and a loop-shaped arrangement at the head and foot ends of the mat portion to accommodate mounting dowels, said mat portion comprising an elastic crosslinked synthetic resin foam sheet, reinforced with a flat textile layer of organic and/or inorganic fibers, threads, strips, or the like, said sheet having a tensile strength of at least 0.20 $N/mm^2$, a tear propagation resistance of at least 1.0 N/mm, and an ultimate elongation of at least 80%, with a gross density of about 30–130, preferably 30–80 $kg/m^3$.

2. A hammock according to claim 1, wherein the head and foot ends of the foam sheet are folded over for loop formation, and the folded-over portion is connected to the mat portion.

3. A hammock according to claim 1, wherein the mat portion comprises two foam sheets with a flat textile layer laminated therebetween.

4. A hammock according to claim 2, wherein the mat portion comprises two foam sheets with a flat textile layer laminated therebetween.

5. A hammock according to claim 1, wherein the laminated flat textile layer is a woven fabric, comprising a strip fabric of a synthetic resin.

6. A hammock according to claim 5, wherein the synthetic of the foam and of the strip fabric resin is a polyolefin.

7. A hammock according to claim 1, wherein the foam sheet is laminated to a synthetic resin film on its topside.

8. A hammock according to claim 1, wherein a woven or knit or nonwoven, flat textile material made of a synthetic resin is connected to the head and foot ends of the mat, by sewing, welding, or gluing to form a loop, on the topside and/or underside of the mat portion.

9. A hammock according to claim 4, wherein the foam sheets are dyed different colors.

10. A laminate according to claim 1, wherein the laminate has a thickness of about 5 20 mm.

* * * * *